US006729259B2

(12) United States Patent
Jerabek et al.

(10) Patent No.: US 6,729,259 B2
(45) Date of Patent: May 4, 2004

(54) OUTFITTING SYSTEM FOR A KAYAK

(75) Inventors: Jesse J. Jerabek, Greenville, SC (US); Anthony E. Lee, Easley, SC (US); Robert M. Kelly, Murphy, NC (US)

(73) Assignee: WaterMark Paddlesports, Inc., Easley, SC (US)

( * ) Notice: Subject to any disclaimer, the term of this patent is extended or adjusted under 35 U.S.C. 154(b) by 0 days.

(21) Appl. No.: 10/215,361

(22) Filed: Aug. 7, 2002

(65) Prior Publication Data

US 2004/0025776 A1 Feb. 12, 2004

(51) Int. Cl.[7] ..... B63B 35/71
(52) U.S. Cl. ..... 114/347; 114/363
(58) Field of Search ..... 114/347, 363

(56) References Cited

U.S. PATENT DOCUMENTS

| | | | | |
|---|---|---|---|---|
| 6,022,255 | A | 2/2000 | Lukanovich | 440/101 |
| 6,443,089 | B1 * | 9/2002 | Goucher et al. | 114/347 |
| 2002/0175549 | A1 * | 11/2002 | Hamilton et al. | 297/383 |

FOREIGN PATENT DOCUMENTS

GB 2 331 235 * 5/1999

OTHER PUBLICATIONS

*Dagger Unveils 2002 Technical Outfitting Innovations*, internet pp. 1–2, Dagger, Inc., Nov. 20, 2001.

*HipGrips Inflatable Hip Pads from Radical Gear Kayak Accessories*, internet p. 1, Radical Gear, dated at least as early as Apr. 3, 2002.

*Feathercraft Hip Fit Kit* picture, instructions and internet description pages, Feathercraft Folding Kayaks, pp. 1–3, Nov. 2000.

* cited by examiner

*Primary Examiner*—Sherman Basinger
(74) *Attorney, Agent, or Firm*—Kolisch Hartwell, P.C.

(57) ABSTRACT

A personal watercraft and an outfitting system for a personal watercraft are disclosed. The personal watercraft includes a cockpit configured to be occupied by a user when using the watercraft; and an item of outfitting coupled to the watercraft at a location at least partially inside of the cockpit, the item of outfitting being configured to help secure the user in the cockpit. The item of outfitting includes a shaped portion configured to contact the user, and a fluid-holding bladder disposed adjacent the shaped portion, wherein the fluid-holding bladder may be selectively filled with a fluid to push the shaped portion against the user to secure the user in the cockpit more tightly.

38 Claims, 4 Drawing Sheets

Fig. 2
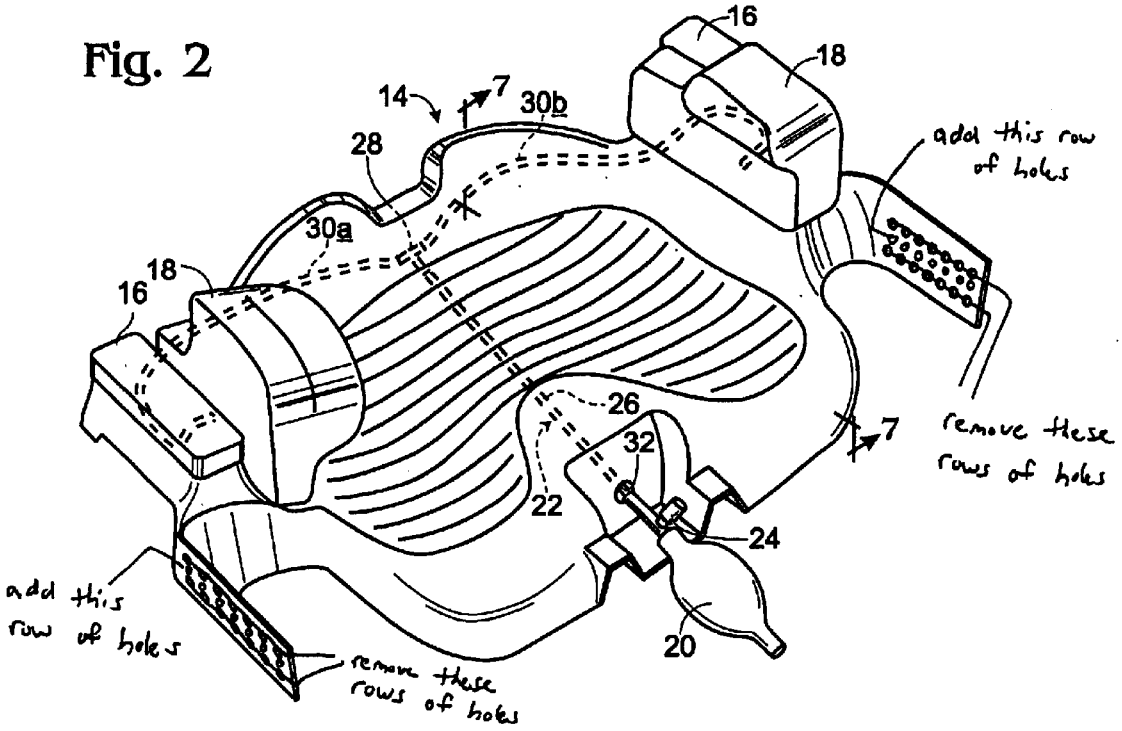
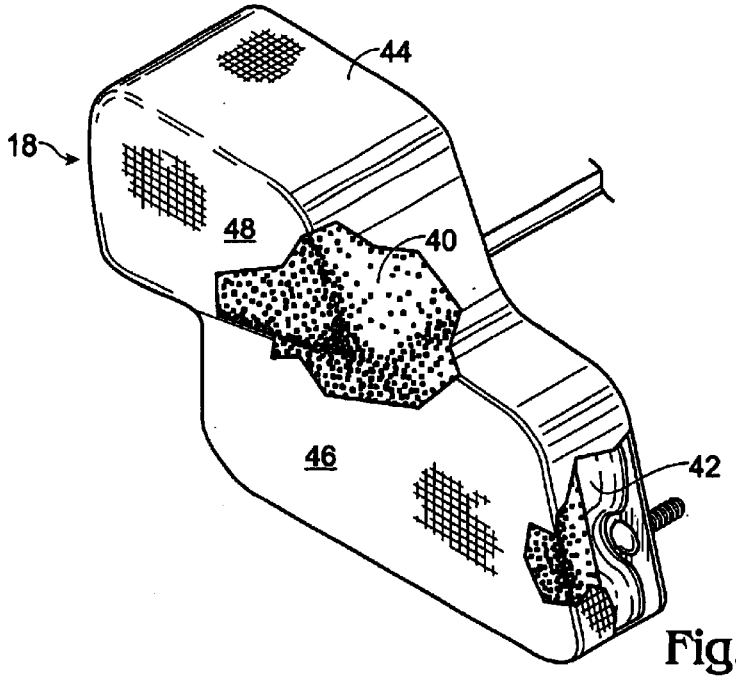
Fig. 3

Fig. 4
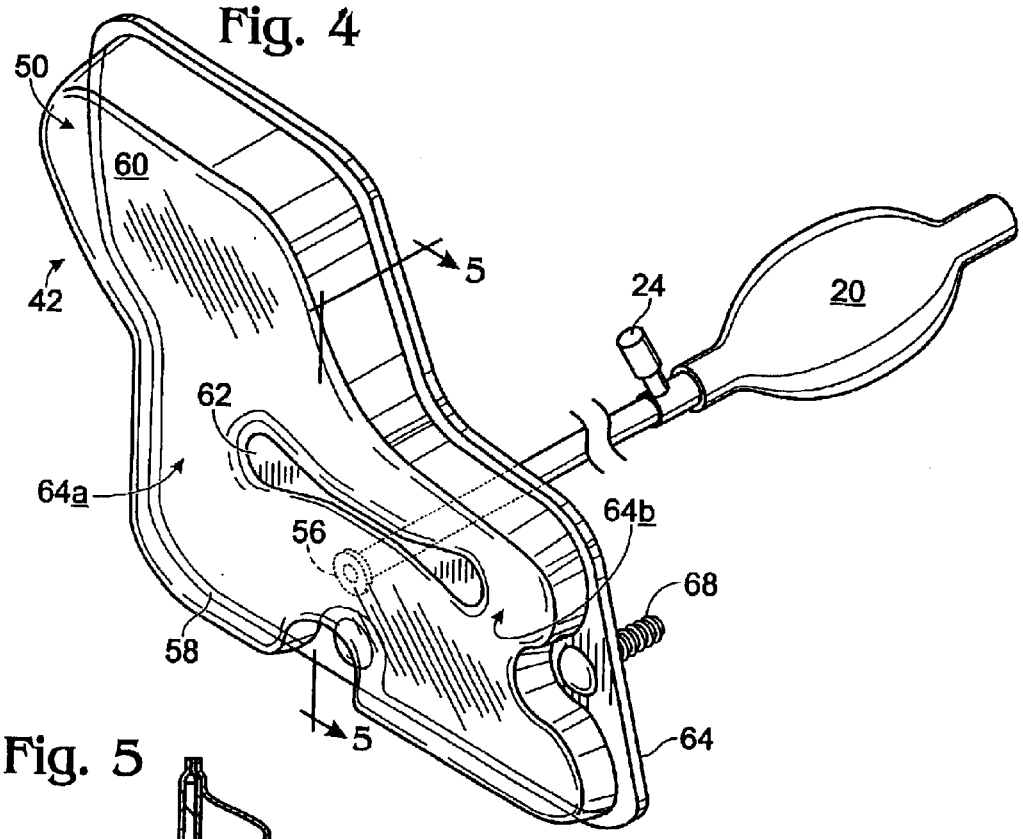
Fig. 5
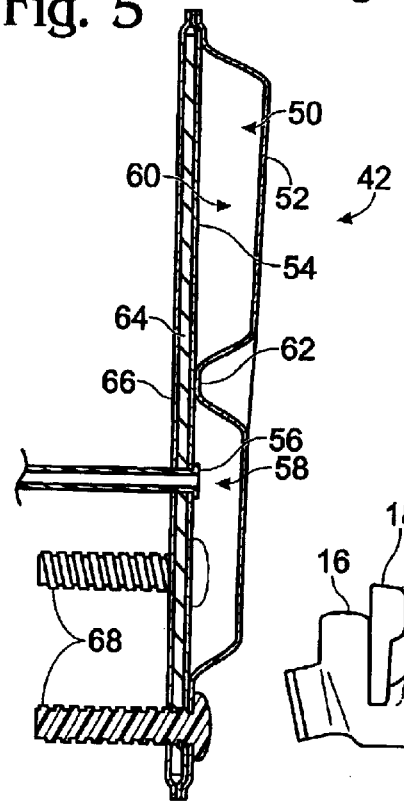
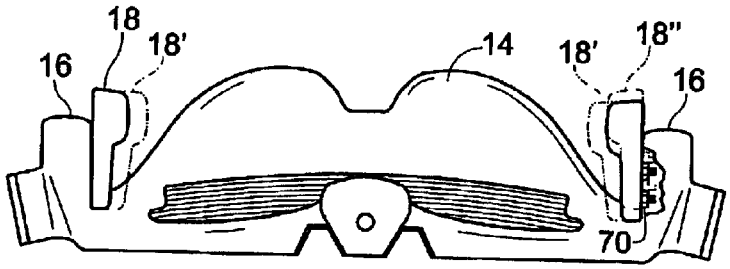
Fig. 6

OUTFITTING SYSTEM FOR A KAYAK

TECHNICAL FIELD

The present invention relates to an outfitting system for a kayak that includes hip pads adjustable by a user seated in the kayak cockpit.

BACKGROUND OF THE INVENTION

A kayak, whether designed for use in whitewater, the sea, or flat water, may includes various items of outfitting configured to improve the comfort and fit of the kayak. For example, a whitewater kayak may include a contoured seat to position and support the user within the cockpit, a back band to support the lower back of the user, and various types of thigh braces, foot braces and hip braces against which the user may exert force to control the boat, and which may help to hold the user in the boat.

To improve the performance of a kayak, a user may modify factory-installed outfitting to fit the user's body more precisely. For example, customized hip pads may be attached to the hip braces. These hip pads may help to hold the user's hips more snugly in the cockpit so that movements of the user's hips are transferred to the kayak more precisely and efficiently. Hip pads are typically formed from closed-cell foam, and are attached to the hip braces with a strong adhesive, such as contact cement, to prevent the pads from shifting or detaching during use.

Where a user anticipates running difficult whitewater or performing advanced freestyle moves, the user may install very snug hip pads for improved boat control. However, a great deal of time may be spent paddling easier water between difficult stretches, or sitting in the kayak in the relative calm of an eddy between freestyle sessions. In these situations, the snug hip pads may cause discomfort. However, because the pads are glued to the hip braces and have a fixed shape, it may be difficult or impossible to loosen the hip pads between rapids or freestyle sessions. Likewise, where a looser, more comfortable fit in a kayak is desired, it may be difficult to increase the snugness of the hip pads for periods when more boat control is desired.

SUMMARY OF THE INVENTION

One aspect of the present invention provides a personal watercraft. The personal watercraft includes a cockpit configured to be occupied by a user when using the watercraft; and an item of outfitting coupled to the watercraft at a location at least partially inside of the cockpit, the item of outfitting being configured to help secure the user in the cockpit. The item of outfitting includes a shaped portion configured to contact the user, and a fluid-holding bladder disposed adjacent the shaped portion, wherein the fluid-holding bladder may be selectively filled with a fluid to push the shaped portion against the user to secure the user in the cockpit more tightly.

Another aspect of the present invention provides a hip pad system for a kayak, the kayak including a cockpit having a hip brace disposed therein. The hip pad system includes a hip pad configured to be attached to the hip brace, the hip pad having a shaped portion configured to contact a user seated in the cockpit and a fluid-holding bladder disposed adjacent the shaped portion. The hip pad system also includes a fluid pump, and a fluid supply line disposed between the fluid pump and the fluid-holding bladder, wherein the fluid pump is operable by the user to selectively pump a fluid into the fluid-holding bladder to push the shaped portion against the user.

Yet another aspect of the present invention provides an outfitting system for a personal watercraft, the personal watercraft including a cockpit having a seat with opposing sides, a first hip brace coupled with one opposing side of the seat, and a second hip brace coupled with the other opposing side of the seat. The outfitting system includes a first hip pad configured to be coupled with the first hip brace, the first hip pad having a first fluid-holding bladder; a second hip pad configured to be coupled with the second hip brace, the second hip pad having a second fluid-holding bladder; a fluid transport line configured to connect the first fluid-holding bladder and the second fluid-holding bladder; and a fluid pump connected to the fluid transport line. The fluid pump is configured to be operable by the user while sitting in the cockpit to allow the user to selectively add and remove fluid from the fluid bladders.

BRIEF DESCRIPTION OF THE DRAWINGS

FIG. 2 is an isometric view of the kayak seat and outfitting system of the embodiment of FIG. 1.

FIG. 3 is a partially broken-away view of a hip pad of the embodiment of FIG. 1.

FIG. 4 is an isometric view of an air bladder of the hip pad of FIG. 3.

FIG. 5 is a sectional view of the air bladder of FIG. 4 taken along line 5—5 of FIG. 4.

FIG. 6 is a front view of the embodiment of FIG. 1, showing the hip pads in a first, looser position in solid lines, and in a second, tighter position in dashed lines.

DETAILED DESCRIPTION OF THE DEPICTED EMBODIMENT

Figure 1:
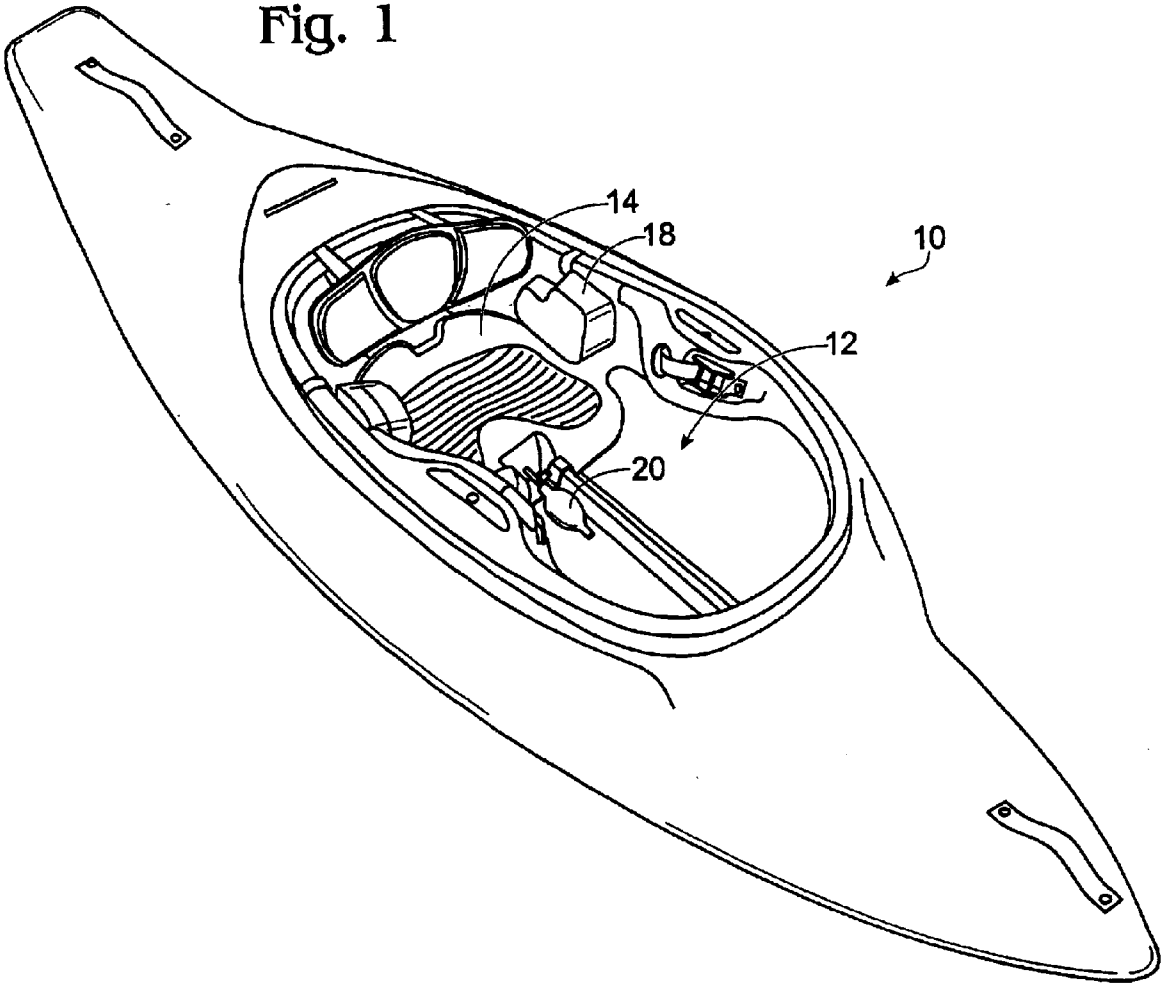
FIG. 1 is a view of a kayak having a first exemplary embodiment of an outfitting system according to the present invention.

FIG. 1 shows, generally at 10, a whitewater kayak having a cockpit 12 equipped with a seat 14. While the depicted embodiment is shown described in the context of a whitewater kayak, it will be understood that an outfitting system according to the present invention may be used in any suitable type of kayak, an open or decked canoe, or any other suitable type of personal watercraft.

FIG. 2 shows seat 14 in more detail. Seat 14 includes an upturned hip brace 16 positioned on each side of the seat in a location adjacent to the hips of a user sitting in seat 14. To increase the accuracy of the fit of seat 14 and hip brace 16 on a user, seat 14 is equipped with a first exemplary embodiment of an outfitting system according to the present invention. The outfitting system includes a hip pad 18 attached to each hip brace 16. Hip pads 18 are configured fit snugly against the hips of a user sitting in seat 14 to permit more precise control of the kayak. To allow the tightness of the fit to be adjusted, each hip pad 18 is connected to a pump 20 via an air supply line 22. Pump 20 and air supply line 22 are configured to allow an air bladder contained within the hip pad to be selectively filled with air when a tighter fit is desired, and to be drained of air when a looser fit is desired. In this manner, a user may quickly, easily and reversibly loosen or tighten the fit of hip pads 18 at any desired time, while remaining seated in cockpit 12 of kayak 10. Furthermore, the fit of hip pads 18 may be adjusted extremely precisely, as the position of each hip pad is infinitely adjustable within its adjustability range.

Any suitable pumping device may be used to expand the bladder within each hip pad 18. In the depicted embodiment, pump 20 takes the form of a squeeze bulb such as that commonly used to inflate a blood pressure cuff. Pump 20 also may include a pressure release valve 24 operable to release air from hip pads 18. While the depicted pressure release valve 24 is integral with pump 20, it will be appreciated that the pressure release valve may be positioned at any other desired location on fluid supply line 22, or on either of hip pads 18. Additionally, while pump 20 is depicted as a squeeze bulb, any other suitable pumping device, or even a compressed gas source, may be used to expand hip pads 18. Furthermore, it will be appreciated that the pump may be configured to transport any other suitable fluid besides air, whether a liquid or gas, to expand hip pads 18.

Air supply line 22 may have any design suitable for transporting air (or other fluid) between hip pads 18, pump 20 and pressure release valve 24. In the depicted embodiment, air supply line 22 includes a first tube segment 26 connecting pump 20 and pressure release valve 24 to a T-connector 28, and a pair of second tubes segments 30*a, b* that extend from the T-connector to hip pads 18. Tube segments 26, 30*a* and 30*b* are positioned mostly underneath seat 14 in the depicted embodiment, with the exception of a small length of first tube segment 26 that extends out of a hole 32 formed in seat 14. This allows pump 20 to be positioned approximately between and below a user's legs, and thus within easy reach of a user seated in cockpit 12. Furthermore, first tube segment 26 may include some extra length so that a user may pull pump 20 a small distance away from seat 14 to facilitate use of the pump.

Positioning the tubes of air supply line 22 beneath seat 14 may help to prevent the tubes from being damaged during use, or when a user is entering or exiting cockpit 12. However, it will be appreciated that the tubes of air supply line 22 may also be positioned at any other desired location within cockpit 12.

Air supply line 22 may also be formed from any suitable components. For example, tube segments 26, 30*a* and 30*b* may be formed from tubing with a relatively small diameter, as small diameter tubing may help slow the shifting of air between the two hip pads 18 during use. One example of a suitable inner diameter for tube segments 26, 30*a* and 30*b* is 3/16", although tubes with either a larger or smaller inner diameter may also be used.

As mentioned above, fluid supply line 22 is configured to deliver air (or other fluid) to a bladder contained within each hip pad 18. FIG. 3 shows the construction of hip pad 18 in more detail. Hip pad 18 includes a relatively rigid shaped portion 40, and an air bladder 42 positioned behind the shaped portion. As a user pumps air into air bladder 42, the air bladder expands and pushes shaped portion 40 more firmly against the hip of the user. Shaped portion 40 is configured to retain its shape regardless of the pressure exerted by air bladder 42, and thus to fit the hip of a user in the cockpit regardless of the amount of air in the air bladder.

Shaped portion 40 and air bladder 42 may be held in position relative to one another in any suitable manner. In the depicted embodiment, shaped portion 40 and air bladder 42 are each contained within an outer cover 44. Outer cover 44 may be formed from any suitable material. Suitable materials include, but are not limited to, elastic fabrics, such as spandex or a blended spandex fabric. Outer cover 44 may be permanently secured to shaped portion 40 and/or air bladder 42, for example, by sewing or gluing, or both the shaped portion and air bladder may be removable from outer cover. Where outer cover 44 is permanently secured to shaped portion 40, a pocket (not shown) may be provided in the back of outer cover 44 to accept the insertion of bladder 42.

Shaped portion 40 may have any suitable configuration. In the depicted embodiment, shaped portion 40 is configured to conform to the curvature of a user's hip and upper thigh. Thus, shaped portion 40 includes a lower portion 46 configured to push laterally against the user's hip to prevent side-to-side motion in the cockpit, and an upper portion 48 that curves at least partially over the top of the user's hip to help hold the user down against seat 14.

Likewise, shaped portion 40 may be formed from any suitable material or materials. Suitable materials include those that are able to generally retain shape under stress, that are lightweight, and/or that are comfortable against a user's body. Examples of suitable materials include, but are not limited to, closed-cell foams, such as a thermoformed EVA foam. Another suitable alternative may be to form shaped portion 40 from a rigid or semi-rigid plastic material covered with a layer of padding.

FIGS. 4 and 5 show bladder 42 in more detail. Bladder 42 includes an air chamber 50 formed from a material with a low permeability to air, and with sufficient flexibility to allow the volume of the air chamber to collapse and expand as needed. One example of a suitable material for the construction of air chamber 50 is polyurethane. In the depicted embodiment, air chamber 50 is formed from an outer piece 52 of polyurethane (or other suitable material) bonded to an inner piece 54 of polyurethane along its perimeter. Air supply line 22 extends into air chamber 50, and is bonded to the air chamber where it enters the air chamber. Air supply line 22 may include a flared end portion 56 to provide more surface area for forming a stronger bond to inner piece 54 of air chamber 50.

Outer piece 52 and inner piece 54 of air chamber 50 may be bonded together in any suitable manner to form air chamber 50. For example, outer piece 52 and inner piece 54 may be bonded together with a strong adhesive that is impermeable to the gasses in air. Alternatively, where outer piece 52 and inner piece 54 are formed of a polymer such as polyurethane, they may be bonded together by a suitable plastic welding technique, such as RF welding. The use of RF welding may be advantageous, as it may create a seam with the same strength and tear resistance as the bulk portions of the polyurethane.

During use, a user may exert a great deal of force against hip pads 18 in a very dynamic manner. For example, the user may be exerting force upwardly against upper portion 48 of hip pad 18 at one instant, and then against lower portion 46 of the hip pad at the next instant. Where air is able to flow freely in air chamber 50 between upper portion 48 and lower portion 46 of hip pad 18, the fit of the hip pad against the user may feel somewhat inconsistent and less secure as air flows within air chamber 50 in response to the user's motions. Therefore, air chamber 50 may also include one or more baffles configured to slow the flow of air between the lower portion of the air chamber, indicated at 58, and the upper portion of the air chamber, indicated at 60.

Any suitable structure for slowing the flow of air between lower portion 58 and upper portion 60 of air chamber 50 may be used as a baffle. In the depicted embodiment, the baffle, indicated at 62, takes the form of a region in the center of air chamber 50 in which outer piece 52 and inner piece 54 of air bladder 50 are bonded to one another. This leaves only a pair of relatively narrow channels 64*a* and 64*b* through which air may flow between the lower portion 58 and upper portion 60 of air chamber 50. This may help to prevent the rapid shift of air within air chamber 50 during use, and thus may help to increase the stability and consistency of fit of hip pads 18 against the user.

As described above, outer piece 52 and inner piece 54 of air chamber 50 are typically formed from a flexible material. To hold air chamber 50 in the correct shape, and to provide a structure with which hip pad 18 may be attached to hip brace 16, bladder 42 may also include a rigid support member 64. Support member 64 may be attached to the other components of bladder 42 in any desired manner. In the depicted embodiment, support member 64 is secured to the other components of bladder 42 by an additional backing piece 66 of material that is bonded to the perimeters of outer piece 52 and inner piece 54 of air chamber 50 to enclose the support member completely. Support member 64 may be formed from any suitable material. One example of a suitable material is rubberized polystyrene, as rubberized polystyrene is stiff, strong, lightweight, and does not absorb water. Likewise, backing piece 66 may also be formed from any suitable material. It may be desirable to form backing piece 66 from the same material as outer piece 52 and inner piece 54 of air chamber 50 to permit backing piece 66 to be bonded strongly to the other pieces via RF welding.

Hip pad 18 may be attached to hip brace 16 in any suitable manner. For example, hip pad 18 may be attached to hip brace 16 with a suitable adhesive, such as contact cement, or with one or more rivets. However, in the depicted embodiment, hip pad 18 includes a pair of threaded bolts 68 for attaching the hip pad to hip brace 16. The use of bolts to attach hip pad 18 to hip brace 16 may allow the position of hip pad 18 within cockpit to be adjusted, as described in more detail below. While the depicted hip pad includes two bolts for attaching the pad to hip brace 16, either more or fewer bolts may be used if desired.

FIG. 6 shows a simple schematic illustrating the adjustability of hip pads 18. Where bladder 42 is drained of air, hip pads 18 are positioned in a looser configuration, closer to the sides of cockpit 12 as indicated in solid lines. On the other hand, where bladder 42 is filled with air, hip pads 18 are positioned in a tighter configuration, further from the sides of cockpit 12, as indicated in dashed lines at 18'. It will be appreciated that hip pads 18 are infinitely adjustable between the fully inflated and fully deflated configurations of bladder 42, and thus may be positioned at any location within the range of possible adjustability, typically 1–3 inches at each hip pad, although the hip pads may have a greater or lesser range of adjustability if desired.

Figure 7:
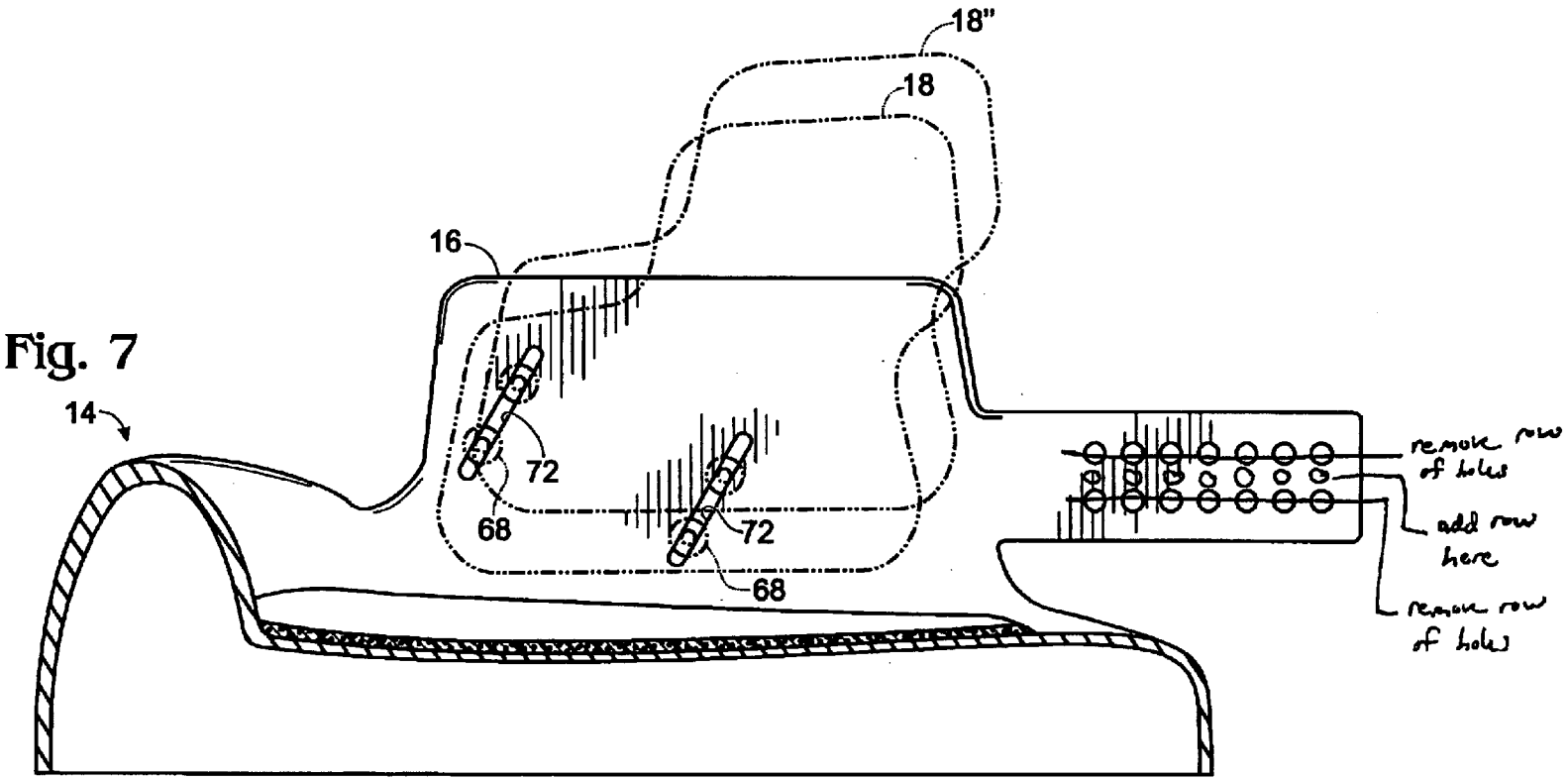
FIG. 7 is a side view of the seat and hip pad of the embodiment of FIG. 1 taken along line 7—7 of FIG. 2, showing two possible positions of the hip pad relative to the seat.

FIGS. 6 and 7 also show a vertical adjustment capability of hip pad 18, as indicated at 18". As described above, each hip pad includes a pair of bolts 68 with which the hip pads are attached to hip braces 16. In turn, each hip brace 16 may include elongate slots, shown at 72 in FIG. 7, configured to receive bolts 68. The use of elongate slots 72 may allow the position of hip pad 18 relative to hip brace 16 to be adjusted by simply moving bolts 68 along the slots until hip pad 18 is in a desired position, and then fixing the bolts in the slots with nuts 70. Slots 72 may be oriented in any desired direction, and may have any suitable length. For example, the slots may be oriented in a true vertical orientation, or may be oriented at an angle from the vertical, for example, 30 degrees forward from the vertical, as shown in FIG. 7. Additionally, where hip brace 18 includes two bolts 68 for attaching the hip pad to hip brace 16, the pitch of the hip pad may also be varied by loosening and shifting only one bolt while holding the other bolt fixed.

Although the present invention has been disclosed in specific embodiments thereof, the specific embodiments are not to be considered in a limiting sense, because numerous variations are possible. The subject matter of the invention includes all novel and nonobvious combinations and subcombinations of the various elements, features, functions, and/or properties disclosed herein. Claims may be presented in a later related application that particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through later amendments or through presentation of new claims in a related application. Such claims, whether broader, narrower, equal, or different in scope to the original claims, also are regarded as included within the subject matter of the invention of the present disclosure.

What is claimed is:

1. A personal watercraft, comprising:

a cockpit configured to be occupied by a user when using the watercraft, wherein the cockpit includes a seat and a hip brace; and a hip pad coupled to the hip brace, the hip pad being configured to help secure the user in the cockpit, wherein the hip pad includes a shaped portion configured to contact the user and a fluid-holding bladder disposed adjacent the shaped portion, wherein the shaped portion includes a foam member configured to conform generally to the hip of a user, and wherein the fluid-holding bladder may be selectively filled with a fluid to push the shaped portion against the user to secure the user in the cockpit more tightly.

2. The personal watercraft of claim 1, wherein the personal watercraft is a kayak.

3. The personal watercraft of claim 1, wherein the personal watercraft is a whitewater kayak.

4. The personal watercraft of claim 1, wherein the foam member is formed from thermoformed EVA foam.

5. The personal watercraft of claim 1, wherein the cockpit includes a pair of opposing hip braces, wherein a hip pad is coupled to each hip brace, and wherein each hip pad includes a shaped portion and a fluid-holding bladder.

6. The personal watercraft of claim 5, further comprising a pump in fluid communication with the hip pads, wherein the pump is operable by a user occupying the cockpit to pump the fluid into the hip pads to push the shaped portion of each hip pad toward the user.

7. The personal watercraft of claim 6, wherein the hip pads are connected to each other and to the pump with a fluid supply line.

8. The personal watercraft of claim 7, wherein the fluid supply line is formed from tubing with a 3/16" inner diameter.

9. The personal watercraft of claim 7, wherein the fluid supply line is positioned substantially beneath the seat.

10. The personal watercraft of claim 1, wherein the fluid-holding bladder is configured to hold air.

11. The personal watercraft of claim 10, wherein the fluid-holding bladder includes an upper portion and a lower portion separated by a baffle configured to slow fluid flow between the upper portion and the lower portion.

12. The personal watercraft of claim 11, wherein the fluid-holding bladder includes a fluid chamber formed from first and second pieces of flexible material bonded around an outer perimeter, and wherein the baffle is formed from a center region in which the two pieces of flexible material are bonded together.

13. The personal watercraft of claim 1, wherein the fluid-holding bladder and the shaped portion are disposed within an outer cover that holds the fluid-holding bladder and shaped portion in a desired position relative to each other.

14. The personal watercraft of claim 13, wherein the outer cover is at least partially formed from a spandex fabric.

15. The personal watercraft of claim 1, further comprising a fluid release valve configured to be operable by the user to release fluid from the fluid-holding bladder.

16. The personal watercraft of claim 1, further comprising a pump operable by a user situated in the cockpit to move the fluid into the fluid-holding bladder.

17. The personal watercraft of claim 16, wherein the pump is a squeeze bulb.

18. The personal watercraft of claim 1, wherein the hip brace includes an elongate slot, and wherein the hip pad is configured to be adjustably attached to the hip brace via a bolt that extends through the elongate slot.

19. A personal watercraft, comprising:

a cockpit;

a seat disposed within the cockpit;

a hip brace disposed within the cockpit adjacent the seat; and a hip pad coupled with the hip brace, wherein the hip pad includes a shaped portion configured to contact a user seated in the cockpit and a fluid-holding bladder disposed adjacent the shaped portion, wherein the shaped portion is made of at least one of a rigid and a semi-rigid material, and wherein a fluid may be selectively added to the fluid bladder to push the shaped portion against the user.

20. The personal watercraft of claim 19, wherein the shaped portion is made of a foam material.

21. The personal watercraft of claim 19, wherein the shaped portion is made of a plastic material.

22. The personal watercraft of claim 19, wherein the shaped portion is shaped to conform generally to a shape of at least one of a user's hip and thigh.

23. A hip pad system for a kayak, the kayak including a cockpit having a hip brace disposed therein, the hip pad system comprising:

a hip pad configured to be attached to the hip brace, the hip pad including a shaped portion configured to contact a user seated in the cockpit and a fluid-holding bladder disposed adjacent the shaped portion;

a fluid pump; and a fluid supply line disposed between the fluid pump and the fluid-holding bladder, wherein the fluid pump is operable by the user to selectively pump a fluid into the fluid-holding bladder to push the shaped portion against the user, and wherein the shaped portion is made of a material configured to hold its shape as it is pushed against the user.

24. The personal watercraft of claim 23, wherein the shaped portion is made of a foam material.

25. The personal watercraft of claim 23, wherein the shaped portion is made of a plastic material.

26. The personal watercraft of claim 23, wherein the shaped portion is shaped to conform generally to a shape of at least one of a user's hip and thigh.

27. An outfitting system for a personal watercraft, the personal watercraft including a cockpit having a seat with opposing sides, a first hip brace coupled with one opposing side of the seat, and a second hip brace coupled with the other opposing side of the seat, the outfitting system including:

a first hip pad configured to be coupled with the first hip brace, the first hip pad having a first fluid-holding bladder;

a second hip pad configured to be coupled with the second hip brace, the second hip pad having a second fluid-holding bladder;

a fluid transport line configured to connect the first fluid-holding bladder and the second fluid-holding bladder, wherein the fluid transport line is configured to be positioned substantially beneath the seat; and a fluid pump connected to the fluid transport line, wherein the fluid pump is operable by the user while sitting in the cockpit to selectively add and remove fluid from each of the fluid bladders.

28. The outfitting system of claim 27, wherein the fluid transport line extends from beneath the seat at a location generally between the legs of the user seated in the cockpit.

29. The outfitting system of claim 27, wherein the fluid transport line includes a first tube segment connecting the fluid pump to a three-way fluid connector, and a pair of second tube segments that connect the three-way fluid connector to the first and second fluid-holding bladders.

30. A personal watercraft, comprising:

a cockpit configured to be occupied by a user when using the watercraft, wherein the cockpit includes a seat having a pair of hip braces;

a hip pad coupled to each hip brace, wherein the hip pad includes a shaped portion configured to contact the user and a fluid-holding bladder disposed adjacent the shaped portion, and wherein the fluid-holding bladder may be selectively filled with a fluid to push the shaped portion against the user to secure the user in the cockpit more tightly;

a pump for inflating the fluid-holding bladders; and a fluid supply line connecting the hip pads to the pump and to each other, wherein the fluid supply line is positioned substantially beneath the seat.

31. A hip pad system for a kayak, the kayak including a cockpit having a hip brace disposed therein, the hip pad system comprising:

a hip pad configured to be attached to the hip brace, wherein the hip pad includes a shaped portion configured to conform generally to a user's body, a fluid-holding bladder disposed adjacent the shaped portion, and a rigid support member coupled with the bladder; and a fluid transport line for transporting fluids to and from the bladder.

32. The hip pad system of claim 31, wherein the rigid support member is coupled with the bladder at a location opposite the shaped portion of the hip pad.

33. The hip pad system of claim 31, wherein the hip pad is configured to be attached to the hip brace by a fastener connected to the rigid support member.

34. The hip pad system of claim 31, wherein the rigid support member is coupled to the bladder via a backing layer that at least partially encloses the rigid support member and that is bonded to the bladder at least partially around the perimeter of the rigid support member.

35. The hip pad system of claim 31, wherein the rigid support member is made of a rigid plastic material.

36. The hip pad system of claim 35, wherein the rigid support member is made of rubberized polystyrene.

37. An outfitting system for a personal watercraft, the personal watercraft including a cockpit having a seat with opposing sides, a first hip brace coupled with one opposing side of the seat, and a second hip brace coupled with the other opposing side of the seat, the outfitting system including:

a first hip pad configured to be coupled with the first hip brace, the first hip pad having a first fluid-holding bladder;

a second hip pad configured to be coupled with the second hip brace, the second hip pad having a second fluid-holding bladder;

a fluid pump configured to be operable by a user sitting in the cockpit to selectively add fluid to the first fluid-holding bladder and the second fluid-holding bladder; and a fluid transport line configured to connect the first fluid-holding bladder and the second fluid-holding bladder to the fluid pump, wherein the fluid transport line includes a first tube segment connecting the fluid pump to a three-way fluid connector, and a pair of second tube segments that connect the three-way fluid connector to the first and second fluid-holding bladders.

38. A personal watercraft, comprising:

a cockpit configured to be occupied by a user when using the watercraft, wherein the cockpit includes a seat having a hip brace; and a hip pad coupled to the hip brace, the hip pad being configured to help secure the user in the cockpit, wherein the hip pad includes a fluid-holding bladder that may be selectively filled with a fluid to push the hip pad against the user to secure the user in the cockpit more tightly, and wherein the fluid-holding bladder includes an upper portion and a lower portion separated by a baffle configured to slow fluid flow between the upper portion and the lower portion.

* * * * *

UNITED STATES PATENT AND TRADEMARK OFFICE

CERTIFICATE OF CORRECTION

PATENT NO. : 6,729,259 B2
DATED : May 4, 2004
INVENTOR(S) : Jerabek et al.

It is certified that error appears in the above-identified patent and that said Letters Patent is hereby corrected as shown below:

The title page showing the illustrative figure should be deleted to be replaced with the attached title page.

Drawing sheets, consisting of Figs. 2 & 7, should be deleted to be replaced with the drawing sheets, consisting of Figs. 2 & 7, as shown on the attached page.

Signed and Sealed this

Thirteenth Day of December, 2005

JON W. DUDAS
*Director of the United States Patent and Trademark Office*

(12) United States Patent
Jerabek et al.

(10) Patent No.: US 6,729,259 B2
(45) Date of Patent: May 4, 2004

(54) OUTFITTING SYSTEM FOR A KAYAK

(75) Inventors: Jesse J. Jerabek, Greenville, SC (US); Anthony E. Lee, Easley, SC (US); Robert M. Kelly, Murphy, NC (US)

(73) Assignee: WaterMark Paddlesports, Inc., Easley, SC (US)

( * ) Notice: Subject to any disclaimer, the term of this patent is extended or adjusted under 35 U.S.C. 154(b) by 0 days.

(21) Appl. No.: 10/215,361

(22) Filed: Aug. 7, 2002

(65) Prior Publication Data

US 2004/0025776 A1 Feb. 12, 2004

(51) Int. Cl.[7] ..... B63B 35/71
(52) U.S. Cl. ..... 114/347; 114/363
(58) Field of Search ..... 114/347, 363

(56) References Cited

U.S. PATENT DOCUMENTS

| | | | | |
|---|---|---|---|---|
| 6,022,255 | A | 2/2000 | Lukanovich | 440/101 |
| 6,443,089 | B1 * | 9/2002 | Goucher et al. | 114/347 |
| 2002/0175549 | A1 * | 11/2002 | Hamilton et al. | 297/383 |

FOREIGN PATENT DOCUMENTS

GB 2 331 235 * 5/1999

OTHER PUBLICATIONS

*Dagger Unveils 2002 Technical Outfitting Innovations*, internet pp. 1–2, Dagger, Inc., Nov. 20, 2001.

*HipGrips Inflatable Hip Pads from Radical Gear Kayak Accessories*, internet p. 1, Radical Gear, dated at least as early as Apr. 3, 2002.

*Feathercraft Hip Fit Kit* picture, instructions and internet description pages, Feathercraft Folding Kayaks, pp. 1–3, Nov. 2000.

* cited by examiner

*Primary Examiner*—Sherman Basinger
(74) *Attorney, Agent, or Firm*—Kolisch Hartwell, P.C.

(57) ABSTRACT

A personal watercraft and an outfitting system for a personal watercraft are disclosed. The personal watercraft includes a cockpit configured to be occupied by a user when using the watercraft; and an item of outfitting coupled to the watercraft at a location at least partially inside of the cockpit, the item of outfitting being configured to help secure the user in the cockpit. The item of outfitting includes a shaped portion configured to contact the user, and a fluid-holding bladder disposed adjacent the shaped portion, wherein the fluid-holding bladder may be selectively filled with a fluid to push the shaped portion against the user to secure the user in the cockpit more tightly.

38 Claims, 4 Drawing Sheets

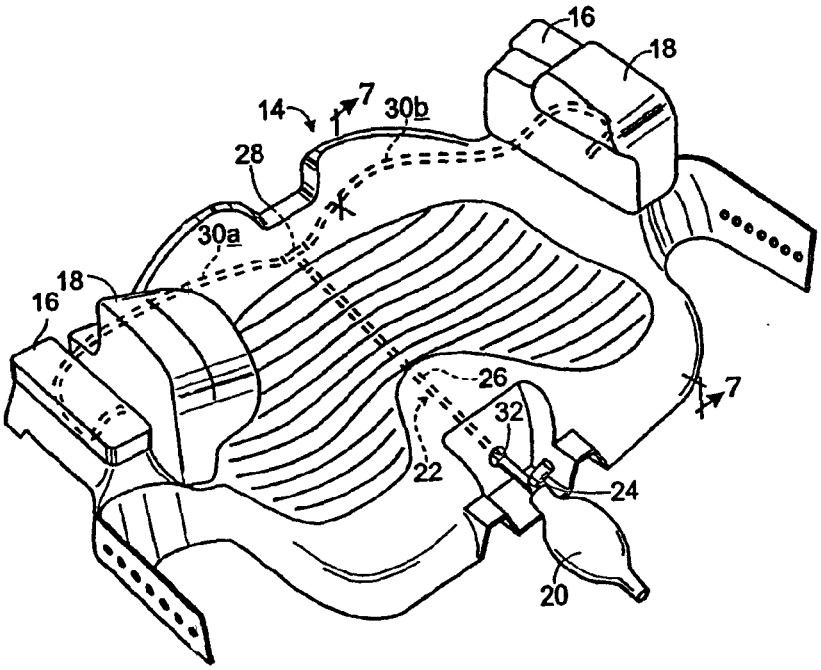

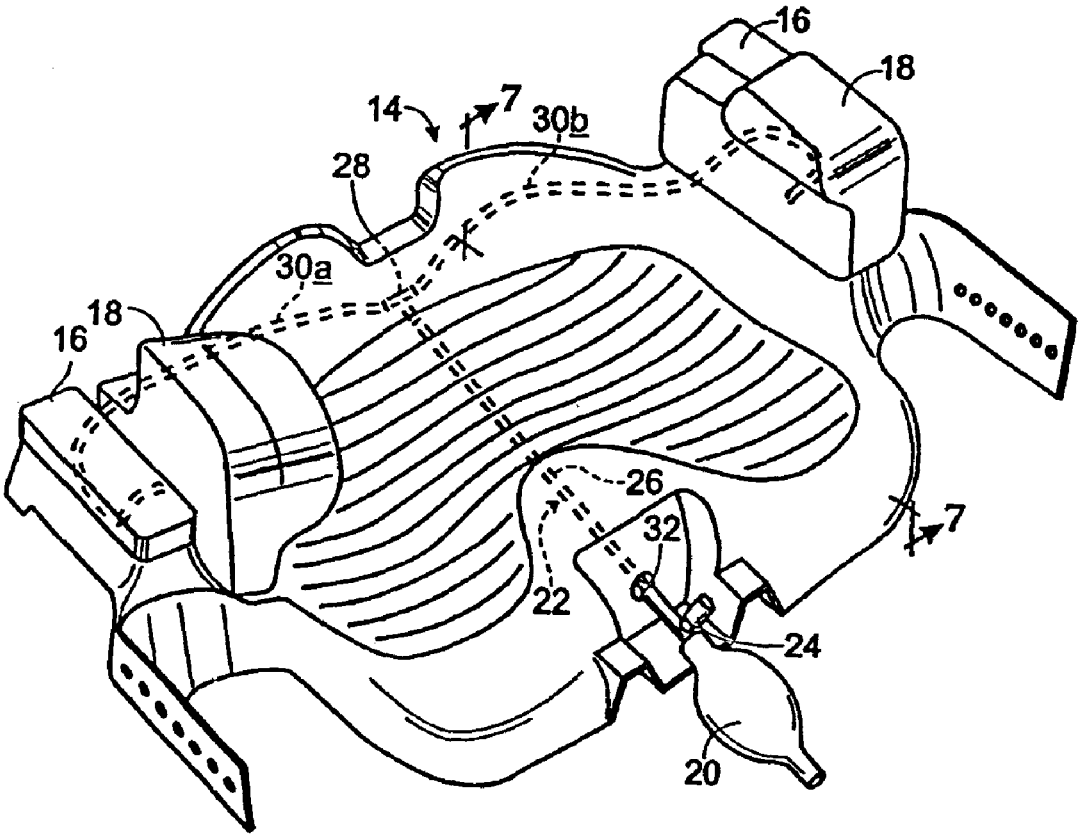
16
18
14
7
30b
28
30a
18
16
26
32
7
22
24
20

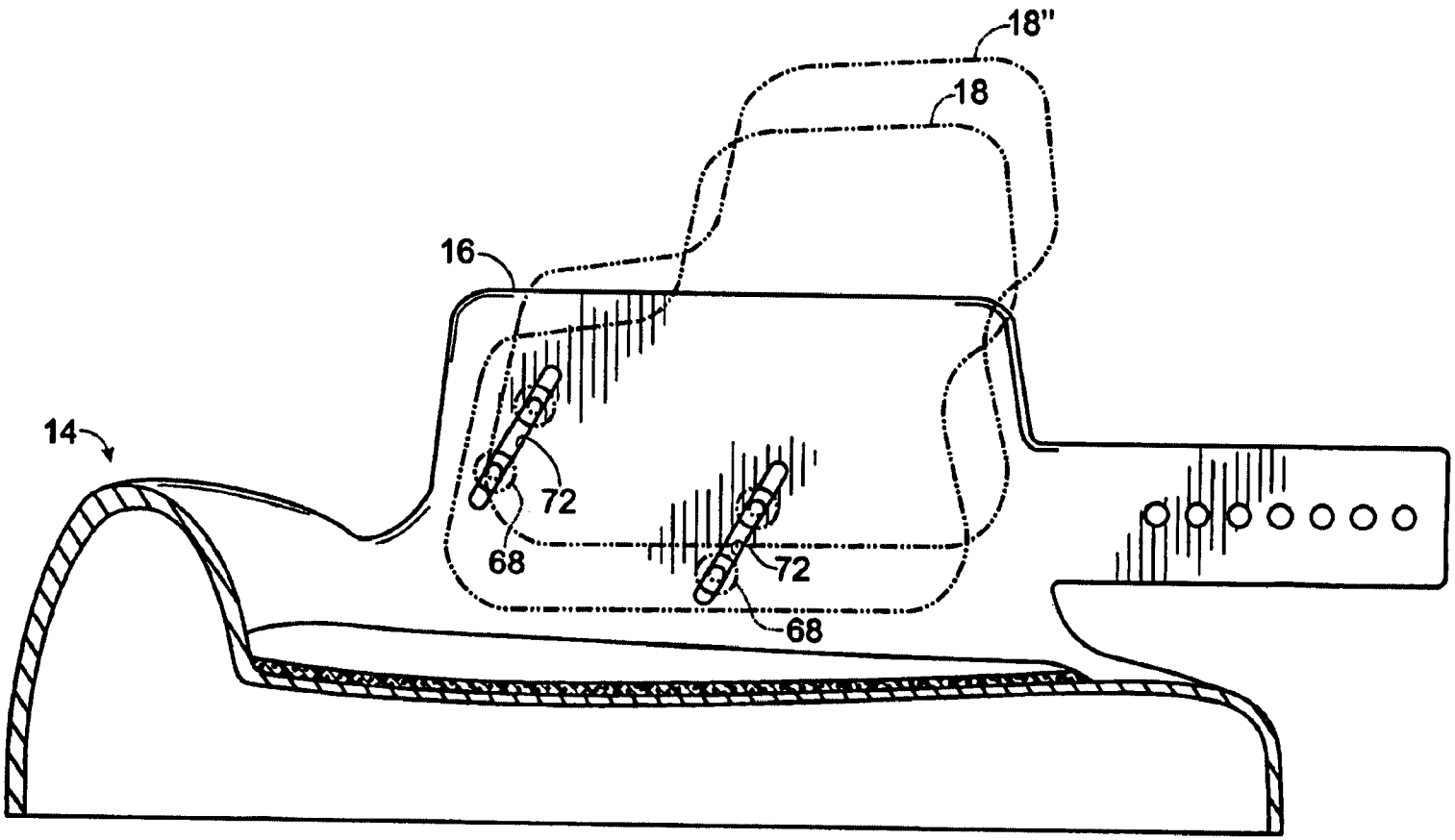
18''
18
16
72
68
72
68
14